US005530229A

United States Patent [19]

Gong et al.

[11] Patent Number: 5,530,229

[45] Date of Patent: Jun. 25, 1996

[54] HEATING TIME CONTROL APPARATUS AND METHOD THEREOF FOR MICROWAVE OVEN

[75] Inventors: Chun S. Gong; Seog T. Kim, both of Kyungsangnam-Do; Young J. Seo, Busan, all of Rep. of Korea

[73] Assignee: LG Electronics Inc., Rep. of Korea

[21] Appl. No.: 413,427

[22] Filed: Mar. 30, 1995

[30] Foreign Application Priority Data

Apr. 1, 1994 [KR] Rep. of Korea ..... 6945/1994

[51] Int. Cl.[6] ..... H05B 6/68

[52] U.S. Cl. ..... 219/711; 219/719; 219/704; 219/492; 99/325

[58] Field of Search ..... 219/711, 710, 219/719, 720, 704, 708, 492; 99/325

[56] References Cited

U.S. PATENT DOCUMENTS

| | | | |
|---|---|---|---|
| 4,379,964 | 4/1983 | Kanazawa et al. | 219/492 |
| 4,401,884 | 8/1983 | Kusunoki et al. | 219/711 |
| 4,629,848 | 12/1986 | Yokozeki et al. | 219/719 |
| 4,831,227 | 5/1989 | Eke | 219/710 |
| 4,918,276 | 4/1990 | Oh | 219/710 |
| 5,155,339 | 10/1992 | An | 219/492 |

*Primary Examiner*—Philip H. Leung

*Attorney, Agent, or Firm*—Ostrolenk, Faber, Gerb & Soffen

[57] ABSTRACT

An improved heating time control apparatus and a method for a microwave oven capable of detecting food temperature using an infrared ray coming from food being heated, whereby better heating time control can be possible, which includes a key input circuit for inputting a cooking menu and a food kinds; an infrared sensor circuit for detecting a surface temperature of food in accordance with the amount of infrared rays coming from food being cooked and for converting the detected temperature into a predetermined electric signal; a microprocessor for outputting a first heating time previously set in accordance with a selected menu and a second heating time previously set in accordance with a food kinds and for monitoring an output signal outputted from the infrared sensor and for outputting a result obtained by multiplying an output signal difference between points of a first heating time completion and a second heating time completion by a predetermined coefficient as a third heating time; and an output control circuit for controlling an output of microwaves in accordance with an output signal of the microprocessor.

4 Claims, 3 Drawing Sheets

HEATING TIME CONTROL APPARATUS AND METHOD THEREOF FOR MICROWAVE OVEN

BACKGROUND OF THE INVENTION

1. Field of the Invention

The present invention relates to a heating time control apparatus and a method thereof for a microwave oven, and particularly to an improved heating time control apparatus and a method for a microwave oven capable of detecting food temperature using art infrared ray coming from food being heated, whereby better heating time control can be possible.

2. Description of the Conventional Art

Conventionally, when cooking food using a microwave oven, various kinds of sensors are used for judging a cooking state of food. Among them, a temperature sensor, a moisture sensor, or a gas sensor are generally used.

A temperature sensor is intended to detect a predetermined variation of a resistance value in accordance with a temperature variation and converts the detected variation into an electric signal. A moisture sensor is intended to detect a predetermined variation of a resistance value in accordance with a density variation of vapor in a heating compartment and converts the detected variation into an electric signal, at this time the moisture is in the form of absolute moisture. In addition, a gas sensor is intended to detect a predetermined variation of a resistance value in accordance with a gas density coming from food being cooked and converts the detected variation into an electric signal.

However, there are some disadvantages in correctly detecting a food cooking state when cooking food with a low heat. Referring to FIG. 1, the variations of the temperature, moisture and gas which are detected by such sensors are shown therein. The control of heating time is performed with a basis of assuming that a point where an output signal is sharply increased is a boiling point (BP) in case of water. However, in case of warming food and unfreezing a frozen meant or fish, or in case of cooking just after a food is cooked, a point where a predetermined output signal is varied is different from a boiling point shown in FIG. 1. Therefore, it becomes difficult to correctly control a total heating time with a basis of such as boiling point.

In an attempt to resolve such disadvantages, there is introduced one method of using a predetermined infrared ray using a pyroelectric effect so as to detect a surface temperature of food. Here, the pyroelectric effect is defined as forming a predetermined electric charge around a predetermined object which is caused as an object which is in an electrically neutralized state is heated thereby breaking a balanced state thereof whereby it is combined with floated ions having opposite electric charges from each other in the air. In addition, the method of using an infrared sensor using the pyroelectric effect for controlling a heating time is directed to detect the surface temperature of food by detecting a variation of electric charge around food varied in accordance with the amount of infrared ray which is varied in accordance with the temperature of food.

Such a method described above has better performance in detecting the surface temperature of food than using a moisture sensor, gas sensor or temperature sensor because the moisture, gas and temperature sensors is intended not to detect the temperature of food but to detect and control the moisture, gas and temperature in the heating compartment.

Therefore, such sensors have disadvantages in detecting food temperature rather than using the pyroelectric effect method.

Even though the pyroelectric effect method has better performance in detecting food temperature, there are still some problems in that detecting food temperature because it is intended to use a differential type sensor for correcting and outputting a difference between a heating compartment temperature and a food temperature, so that when a temperature difference occurs slowly it is difficult to correctly detecting food temperature. In addition, to adapt such a method, there should be provided a chopper mounted in front of an infrared sensor so as to forcibly make a predetermined temperature variation therein, whereby the manufacturing cost increase.

SUMMARY OF THE INVENTION

Accordingly, it is an object of the present invention to provide a heating time control apparatus and a method thereof for a microwave oven which does not involve the problems encountered in the conventional heating time control apparatus and a method thereof for a microwave oven.

It is another object of the present invention to provide an improved heating time control apparatus and a method thereof for a microwave oven capable of detecting food temperature using an infrared ray coming from food being heated, whereby better heating time control can be possible.

To achieve the above objects, there is provided with a heating time control apparatus for a microwave oven, which includes a key input circuit for inputting a cooking menu and a food kinds; an infrared sensor circuit for detecting a surface temperature of food in accordance with the amount of infrared rays coming from food being cooked and for converting the detected temperature into a predetermined electric signal; a microprocessor for outputting a first heating time previously set in accordance with a selected menu and a second heating time previously set in accordance with a food kinds and for monitoring an output signal outputted from the infrared sensor and for outputting a result obtained by multiplying an output signal difference between points of a first heating time completion and a second heating time completion by a predetermined coefficient as a third heating time; and an output control circuit for controlling an output of microwaves in accordance with an output signal of the microprocessor.

In addition, there is provided with a heating time control method for a microwave oven, which includes the steps of a first step which determines a first heating time in accordance with a cooking menu and a second heating time in accordance with a food kinds; a second step which detects a temperature using an infrared ray coming from food being cooked and performs a heating operation of food for the first heating time; a third step which detects a temperature using an infrared ray coming from food being cooked and performs a heating operation of food for the second heating time; and a fourth step which performs a third heating operation for a predetermined time obtained by multiplying a difference between a temperature of food at a first heating time completion and a temperature of food at a second heating time completion by a predetermined coefficient.

DETAILED DESCRIPTION OF THE INVENTION

Figure 1:
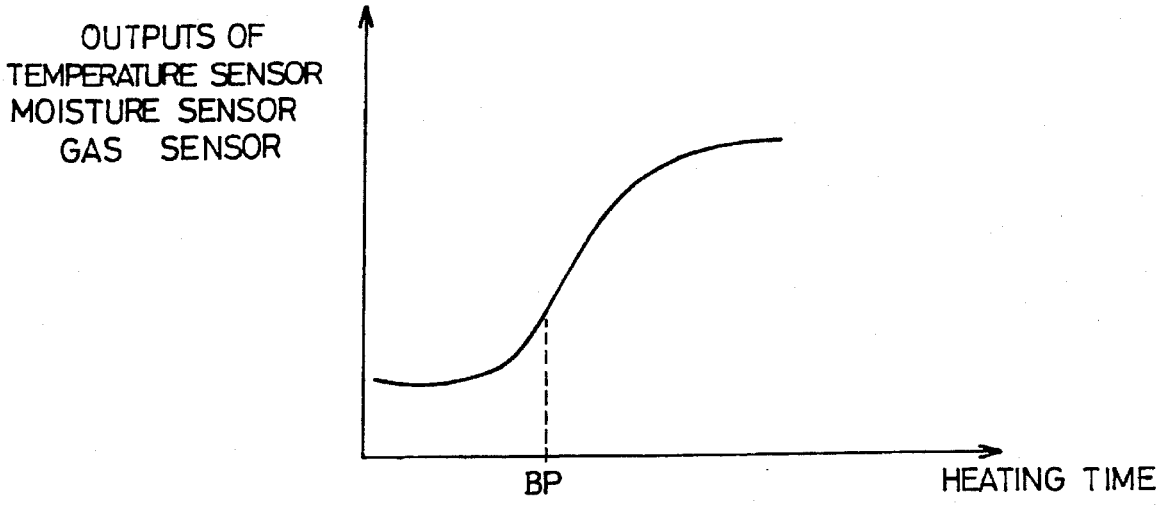
FIG. 1 CONVENTIONAL ART
FIG. 1 a graph showing a characteristic of a signal outputted from a conventional sensor while heating food.
Figure 2:
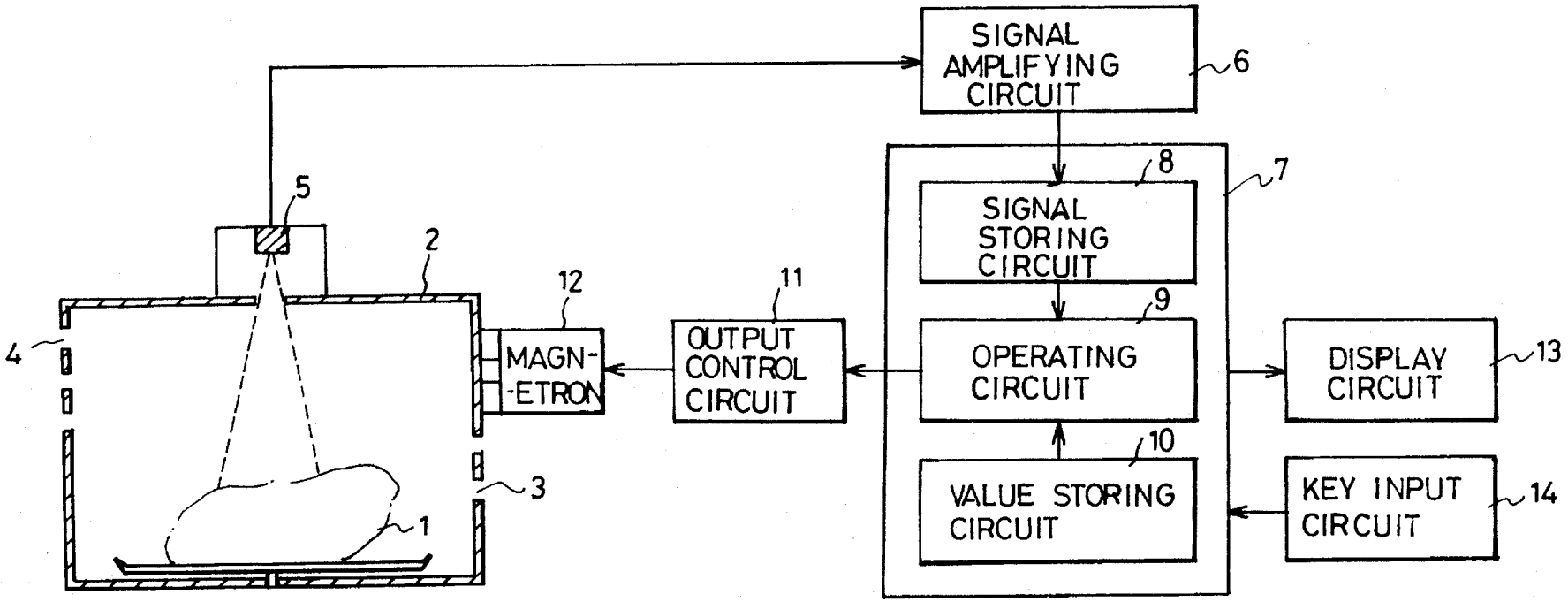
FIG. 2 is a block diagram showing a heating time control apparatus for a microwave oven according to the present invention.
Figure 3:
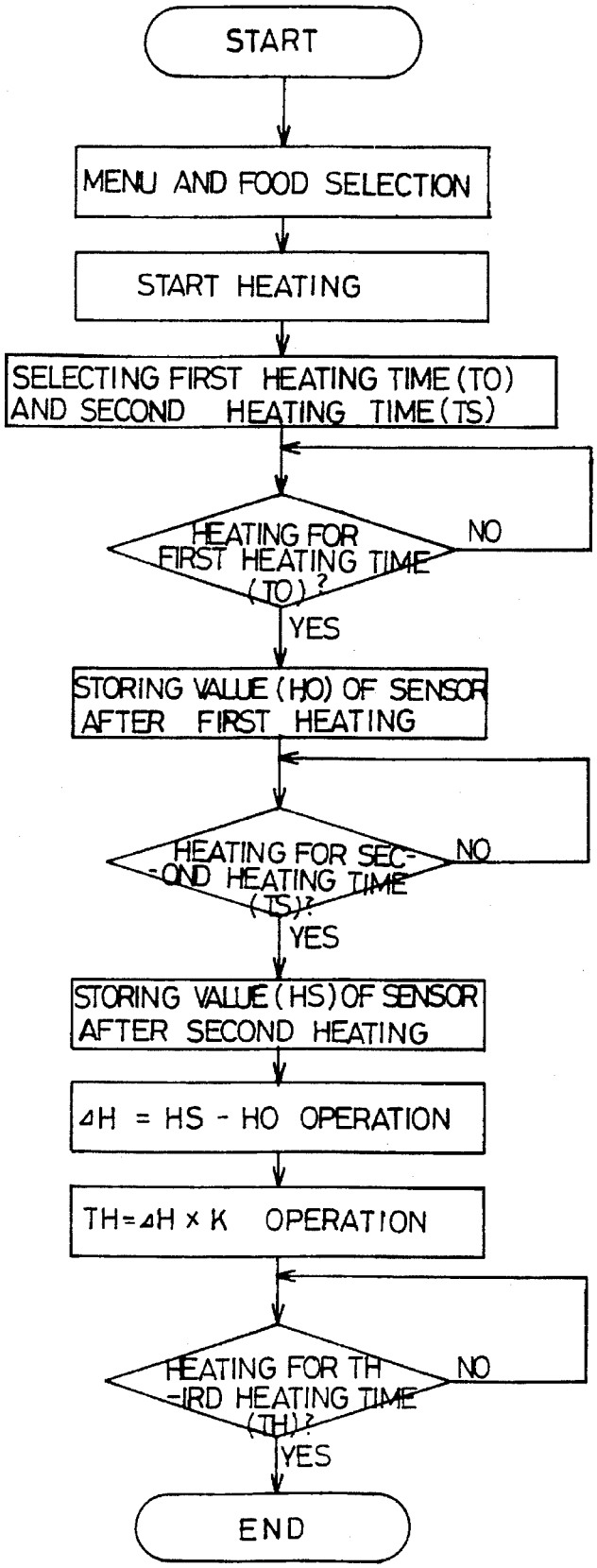
FIG. 3 is a flow chart showing a heating time control method for a microwave oven according to the present invention.

A heating time control apparatus and a method thereof for a microwave oven according to the present invention as shown in FIG. 2 is provided with a heating compartment 2 for heating a food 1, a sensor circuit 5 for detecting a surface temperature of the food 1 in accordance with the amount of infrared ray coming from food being cooked and for converting the detected temperature into a predetermined electric signal, a signal amplifying circuit 6 for amplifying the output signal outputted from the infrared sensor circuit 5 to a predetermined level, a microprocessor 7 for outputting a second heating time TS previously set in accordance with a cooking menu and for monitoring an output signal of the signal amplifying circuit 6 and for outputting a third heating time TH obtained by multiplying a difference of the output signals outputted from the signal amplifying circuit 6 which are detected at points of the first and second heating completion times TO and TS by a predetermined coefficient, an output control circuit 11 for controlling a drive of the magnetron 12 in accordance with an output signal of the microprocessor 7, a magnetron 12 for supplying the heating compartment 2 with microwaves in accordance with an output signal of the output control circuit 11, a display circuit 13 for displaying a current operationally state thereon, and a key input circuit 14 for inputting a predetermined control command of a food kinds and cooking menu.

In addition, the microprocessor 7 includes a signal storing circuit 8 for storing an output signal outputted from the signal amplifying circuit 6, a value storing circuit 10 for storing a first heating time TO based upon a cooking menu, a second heating time TS based upon a food kinds, and a coefficient K based upon a food kinds, and an operator 9 for outputting the first heating time TO and the second heating time TS which are outputted from the value storing circuit 10 and for computing a difference of the output values HO and HS at the time when the first and second heating times TO and TS are terminated and for multiplying the computed difference by a predetermined coefficient K outputted from the value storing circuit 10. Here, reference numerals 3 and 4 each denote an intake opening and an exhausting opening.

The operation of a heating tome control apparatus for a microwave oven will now be explained.

When a user puts a food 1 in the heating compartment 2 and selects a desired menu related to the put food and its kinds, the microprocessor 7 selects a corresponding one among the first heating time and the second heating time in accordance with the selected cooking menu and food kinds. That is, the microprocessor 7 outputs the first heating time TO related selected cooking menu and food kinds from the value storing circuit 10 storing the first heating time TO obtained from an experimental data basis to the output control circuit 11. In addition, the microprocessor 7 also selects the second heating time TS related to the selected food from the value storing circuit 10 storing the second heating time TS obtained from an experimental data basis and outputs the selected time to the output control circuit 11. Thereafter, the output control circuit 11 controls a drive of the magnetron 12 for the first and second heating times TO and TS outputted from the microprocessor 7 and then the magnetron 12 supplies the heating compartment 2 with microwaves in accordance with a control of the output control circuit 11.

Thereafter, the temperature of the food 1 varies and then the amount of the infrared rays coming from the food 1 varies. The infrared rays coming from the food 1 are detected by the infrared ray sensor 2 which is directed to detect the temperature of the food 1 using the thermoelectric power outputted from a thermopile in accordance with a variance of the amount(density) of the infrared rays detected by the infrared sensor 2.

The infrared ray sensor 5 adapted to the present invention consists of a plurality of thermopile, each of which consists of a plurality of thermo couple, which are also classified into a R-type (Platinum Rhodium, Platinum), a K-type (Nickel chromel, Nickel Alumel), a J-type (Iron, Constantan), a T-type and a E-type in accordance with their materials used. The infrared sensor 5 using the thermopile detects the temperature of the food 1 using a predetermined voltage level obtained by adding a thermo electric power coming from each thermo couple when a predetermined infrared ray coming from the food 1 is advanced toward each of the thermopile.

The signal detected by the infrared sensor 5 is amplified to a predetermined level at the signal amplifying circuit 6 and outputted to the operator 9 through the signal storing circuit 8 of the microprocessor 7. The operator 9 monitors the output signals of the signal storing circuit 8 and memories the output value of the signal storing circuit 8 as the HO value that is, the temperature of the food 1, when the previously set first heating time TO is terminated. Thereafter, the heating operation of the food 1 is performed for the previously set second heating time TS and then the operator 9 memories the output value of the signal storing circuit 8 as the HS value when the second heating time TS is terminated.

After the second heating operation is completed, the third heating operation begins at the operator 9. Here, the third heating time TH is given a predetermined value which is obtained by multiplying the value ($\Delta H=HS-HO$) of the varied temperature for the second heating time TS by a predetermined coefficient K outputted from the value storing circuit 10, thereby yielding the following condition.

$$TH=\Delta(HS-HO)\times K \qquad \text{formula 1}$$

Therefore, the total heating time can be expressed as follows.

$$T=TO+TS+TH=TO+TS+(\Delta\times K) \qquad \text{formula 2}$$

In addition, the operator 9 outputs the operated third heating time TH to the output control circuit 11, and the output control circuit 11 controls the magnetron 12. Here, the magnetron 12 supplies the heating compartment 2 with microwaves for the third heating time TH and then the cooking operation is terminated.

In the above formulas 1 and 2, the heating time and coefficient TO, TS and K each are obtained from an experimental basis which are different in accordance with the cooking menu and food kinds and then stored into the value storing circuit 10. In addition, the time TO and the coefficient K include zero however, the TS is set not to be zero. Therefore, if the TO is zero in the formula 2, the total heating time T is given as follows.

$$T=TS+TH=TS+(\Delta\times K) \qquad \text{formula 3}$$

and then if the K is zero, the total heating time T is $$T=TO+TS \quad \text{formula 4}$$

In addition, if both the TO and the K are zero, the following condition is given.

$$T=TS \quad \text{formula 5}$$

As described above, the present invention is intended to continuously detect the infrared rays using the infrared ray detecting method using a thermopile without using a chopper and then to detects a predetermined variance based thereupon thereby more correctly controlling the heating time compared with the conventional arts whereby the circuit construction thereof become simple and thus the manufacturing cost will be substantially reduced.

What is claimed is:

1. A heating time control apparatus for a microwave oven, comprising:

a key input circuit for inputting a cooking menu and a food kind;

an infrared sensor circuit for detecting surface temperature of food being cooked based on infrared rays emanating from said food and for converting the detected surface temperature into an electric signal;

a microprocessor for outputting a first heating time previously set in accordance with a selected menu and a second heating time previously set in accordance with a food kind and for monitoring said electric signal and for outputting a result obtained by multiplying an output signal difference between temperatures corresponding to a first heating completion time and a second heating completion time by a predetermined coefficient as a third heating time; and an output control circuit for controlling a microwave output in accordance with said third heating time.

2. The apparatus of claim 1, wherein said microprocessor includes a signal storing circuit for storing an output signal of said infrared sensor circuit; a value storing circuit for storing said first heating time in accordance with said cooking menu, said second heating time in accordance with said food kind, and said predetermined coefficient in accordance with said food kind; and an operating circuit for outputting said first heating time and said second heating time obtained from said value storing circuit and for computing a difference between points of the first heating completion time and the second heating completion time and for outputting said third heating time obtained by multiplying the computed difference by said predetermined coefficient outputted from the value storing circuit.

3. The apparatus of claim 1, wherein said heating time control apparatus further includes a signal amplifying circuit for amplifying an output signal of the infrared sensor circuit and outputting the implied signal to the microprocessor.

4. A heating time control method for food being cooked in a microwave oven, comprising the steps of:

determining a first heating time in accordance with a cooking menu and a second heating time in accordance with a food kind;

detecting a first temperature of said food using infrared rays emanating from said food being cooked at about the conclusion of said first heating time;

detecting a second temperature of said food using infrared rays emanating from said food being cooked at about the conclusion of said second heating time; and performing a third heating operation for a predetermined time period obtained by multiplying a difference between said first and second temperatures by a predetermined coefficient.

* * * * *